US006033052A

United States Patent [19]

Muraki

[11] Patent Number: 6,033,052

[45] Date of Patent: Mar. 7, 2000

[54] INK JET RECORDING APPARATUS

[75] Inventor: Motohito Muraki, Nagoya, Japan

[73] Assignee: Brother Kogyo Kabushiki Kaisha, Nagoya, Japan

[21] Appl. No.: 08/804,111

[22] Filed: Feb. 20, 1997

[30] Foreign Application Priority Data

Feb. 23, 1996 [JP] Japan ..... 8-062094

[51] Int. Cl.[7] ..... B41J 2/165

[52] U.S. Cl. ..... 347/33; 347/36

[58] Field of Search ..... 347/33, 29, 36; 15/250.42, 250.001, 256.5

[56] References Cited

U.S. PATENT DOCUMENTS

| | | | |
|---|---|---|---|
| 5,151,715 | 9/1992 | Ward et al. | 347/33 |
| 5,168,291 | 12/1992 | Hiramatsu et al. | 347/29 |
| 5,396,271 | 3/1995 | Premnath | 347/33 |
| 5,478,605 | 12/1995 | Ichise | 427/421 |
| 5,486,850 | 1/1996 | Nakamura | 347/24 |
| 5,555,461 | 9/1996 | Ackerman | 347/33 |
| 5,621,450 | 4/1997 | Kawai et al. | 347/108 |

FOREIGN PATENT DOCUMENTS

| | | | |
|---|---|---|---|
| 407214785A | 8/1995 | Japan | 347/33 |

*Primary Examiner*—John Barlow
*Assistant Examiner*—Michael S. Brooke
*Attorney, Agent, or Firm*—Oliff & Berridge, PLC

[57] ABSTRACT

An ink jet recording apparatus comprises a wiper 15 provided with a main part 16 for wiping nozzle faces and a lower contacting part 17 which comes into contact with a lower front portion of an ink jet head, the lower contacting part 17 is provided with a groove in which the wiped ink is allowed to flow to a wiper holder 30 side. The lower contacting part 17 is formed with a torsion angle so that the lower front portion can come first into contact with an upper surface of the lower contacting part 17 at the start of wiping, and an side end of the lower front portion is designed into a rounded or a chamfered shape so as to guide the lower contacting part under the lower front portion. The angle of elevation of the lower contacting part 17 is designed to an angle whereby the bent portion is positioned higher than the other portion of the lower contacting part 17 in order to prevent the ink wiped from remaining there.

11 Claims, 8 Drawing Sheets

INK JET RECORDING APPARATUS

BACKGROUND OF THE INVENTION

1. Field of the Invention

The present invention relates to an ink jet recording apparatus provided with a wiper member for making recovery of an ink ejecting condition of ink, and more particularly to an ink jet recording apparatus comprising a wiper member having a function of removing the ink having gathered in a lower end portion of an ink jet head.

2. Description of Related Art

Conventionally, ink jet recording apparatuses are provided with a wiper mechanism for wiping ink from nozzle faces of an ink jet head. In ink jet heads, there is a case that repeats of ink ejection from nozzles result in the accumulation of surplus ink on the nozzle faces, thereby causing deterioration in the ink ejection. The wiper mechanism is therefore arranged to remove the surplus ink in order to recover the ink ejecting condition. Specifically, a flexible wiper member is disposed between a home position of a carriage on which the ink jet head is mounted and a recording area, so as to be able to protrude toward and separate from moving faces of the nozzles. When the carriage is moved from the home position toward the recording area, the wiper member is made to protrude toward the nozzle faces to wipe them so that a recording operation is conducted under a fine ink ejecting condition.

In the inside of the ink jet head, there may also occur deterioration of ink such as the generation of air bubbles and variation in ink viscosity, or the occurrence of solidified ink. Common ink jet recording apparatuses are accordingly provided with a purge mechanism for sucking-removing the deteriorated ink, separately from the wiper mechanism. This purge mechanism generally is for sucking ink staying in the ink jet head by a pump by covering the nozzle faces of the ink jet head. Due to the purging operation, a part of ink sucked from the inside of the ink jet head is allowed to remain in the nozzle faces, resulting in surplus ink. A wiping operation is therefore needed prior to the start of the next recording operation after completion of the purge operation.

In the conventional ink jet recording apparatuses, however, the wiper member wipes only the nozzle faces of the ink jet head, whereas the surplus ink may be collected in not only the nozzle faces but also other portions. Specifically, there is a case of an ink jet head recording apparatus wherein an ink jet head is disposed obliquely above a recording sheet at a recording position. In this apparatus, a lower front portion of the ink jet head (the front portion indicates herein a near side to the recording sheet) is arranged at the lowest position of the ink jet head, so that the surplus ink is allowed to move toward that portion under the influence of gravity. Since the lower front portion is not wiped by the wiping mechanism, the surplus ink is left collected therein. As this state is, the next recording operation is made to start. In particular, when the purging operation is repeated for plural times, the surplus ink collected therein comes to considerable quantity and thus often drips from the ink jet head during a recording operation to form spots on a recording sheet and each component of the apparatus.

SUMMARY OF THE INVENTION

The present invention has been made in view of the above circumstances and has an object to overcome the above problems and to provide an ink jet recording apparatus capable of preventing surplus ink from causing spots by wiping a lower front portion of an ink jet head, in which surplus ink is apt to gather, by a wiper member.

Additional objects and advantages of the invention will be set forth in part in the description which follows and in part will be obvious from the description, or may be learned by practice of the invention. The objects and advantages of the invention may be realized and attained by means of the instrumentalities and combinations particularly pointed out in the appended claims.

To achieve the objects and in accordance with the purpose of the invention, as embodied and broadly described herein, an ink jet recording apparatus of this invention comprises an ink jet head for ejecting ink from nozzles on a recording media and a wiper member for wiping the ink jet head, wherein the wiper member is provided with a main part for wiping faces of the nozzles of the ink jet head, and a lower contacting part which is brought into contact with a lower front portion of the ink jet head.

The ink jet recording apparatus according to the present invention further comprises a bent portion which is formed at a top end of the lower contacting part, the bent portion directly contacting the lower front portion of the ink jet head.

In the ink jet recording apparatus according to the present invention, the wiper member may be installed in a wiper holder and a groove in which ink is allowed to flow toward the wiper holder is formed continuously in the lower contacting part and the bent portion of the wiper member.

In the ink jet recording apparatus according to the present invention, an ink absorbing member may be arranged under the wiper holder and the ink wiped by the wiper member is introduced into the ink absorbing member through the groove.

In the ink jet recording apparatus of the present invention, the lower contacting part of the wiper member may have a cross-section with a larger size in width than a size in height, and may be constructed with an angle of torsion in a direction of the ink jet head moving in a wiping operation so that an upper surface of the bent portion smoothly comes into contact with one side of the lower front portion of the ink jet head at the start of wiping.

In the ink jet recording apparatus of the present invention, the one side of the lower front portion of the ink jet head may be formed in a form for guiding the lower contacting part of the wiper member under the ink jet head at the start of wiping, and may be formed in a curved or chamfered form.

In the ink jet recording apparatus of the present invention, the lower contacting part of the wiper member may be disposed at an angle of elevation so that the bent portion is positioned higher than the other portion of the lower contacting part when the lower contacting part is not in contact with the ink jet head.

In the ink jet recording apparatus of the present invention, the main part and the lower contacting part may be formed into one body from rubber material, and the rubber material may be ethylene-propylene rubber.

According to the above ink jet recording apparatus, a wiper member is provided with not only a main part for wiping nozzle faces of the ink jet head, but also a lower contacting part which comes into contact with a lower front portion of the ink jet head, so that the wiping operation by the wiping member can remove the surplus ink collected in the lower front portion of the ink jet head as well as the surplus ink collected on the nozzle faces. Consequently, it is possible to perform a recording operation by the ink jet head with its whole outer surface cleaned. This can obtain recording results with a high quality without spots formed by the surplus ink on the medium to be recorded.

According to the ink jet recording apparatus of the present invention, as the wiper member is provided with a groove in the lower contacting part and the bent portion, the ink moving from the lower front portion of the ink jet head to the lower contacting part and the bent portion of the wiper member by a wiping operation is made to flow in the groove toward the wiper holder. In this way, the ink being removed from the lower contacting part and the bent portion, the sequent wiping operation can be performed by the wiper member, enabling the sure effect of wiping in each operation. The wiper member is commonly provided with an ink absorbing member in the wiper holder, thereby to absorb and store the ink wiped.

According to the ink jet recording apparatus of the present invention, the lower contacting part is formed with a cross section having a larger width than a thickness (height), so that the contacting part can bend up and down in coming into contact with the lower front portion of the ink jet head in wiping. As a result, the lower contacting part can be brought into contact with the lower front portion while exerting a certain pressure force thereto without giving load on the ink jet head and a carriage mounting the ink jet head thereon and the like. This enables the effect of wiping by the wiper member.

According to the ink jet recording apparatus of the present invention, the lower contacting part is formed with an angle of torsion with respect to the ink jet head so that the upper surface comes into contact with one side of the lower front portion of the ink jet head at the start of wiping. The lower contacting part can accordingly be bent smoothly in wiping and be brought into contact with the lower front portion of the ink jet head at the upper surface, enabling the effect of wiping.

According to the ink jet head of the present invention, one side of the lower front portion of the ink jet head, which is an end portion that will first come into contact with the lower contacting part of the wiper member in starting wiping, is formed so as to guide the lower contacting part under the lower surface of the ink jet head. This makes it possible to allow the lower contacting part of the wiper member to smoothly bend along the form of the one side end portion in wiping, whereby to surely make the upper surface of the lower contacting part contact with the lower front portion of the ink jet head. As the form for guiding, there are proposed a slant form by chamfering a corner of the lower front portion of the ink jet head or a curved form by rounding off the corner.

According to the ink jet head of the present invention, the angle of elevation of the lower contacting part is designed so that the bent portion is positioned higher than the other portion of the lower contacting part when the lower contacting part is not in contact with the ink jet head. The ink moved from the lower front portion of the ink jet head into the lower contacting part in a wiping operation, is naturally led to the wiper holder along the lower contacting part under the influence of gravity as soon as the lower contacting part is separated from the ink jet head after the completion of the wiping operation. As a result, a sequent wiping operation can be performed with the wiper member cleaned without ink as attached therein, thus enabling the effect in every wiping operation. An ink absorbing member is commonly provided in an installation side of the wiper member, namely, in a wiper holder, to absorb and store the ink wiped.

BRIEF DESCRIPTION OF THE DRAWINGS

The accompanying drawings, which are incorporated in and constitute a part of this specification illustrate an embodiment of the invention and, together with the description, serve to explain the objects, advantages and principles of the invention.

In the drawings.

DETAILED DESCRIPTION OF THE PREFERRED EMBODIMENTS

A detailed description of one preferred embodiment of an ink jet recording apparatus embodying the present invention will now be given referring to the accompanying drawings.

Figure 1:
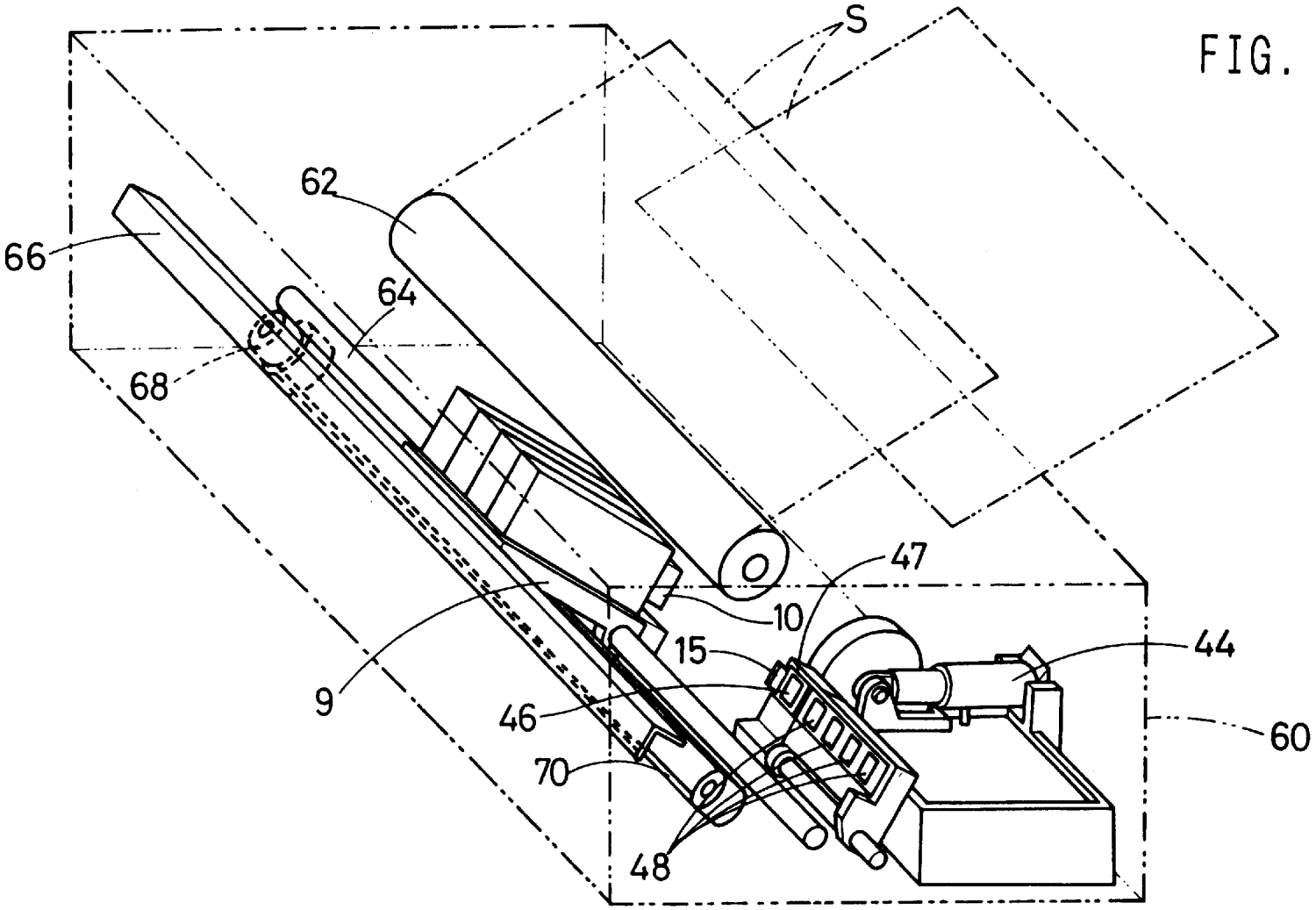
FIG. 1 is a schematic perspective view of an ink jet recording apparatus in an embodiment according to the present invention.

FIG. 1 shows a schematic perspective view of the ink jet recording apparatus in the embodiment, which is provided with a casing 60 and, inside thereof, a cylindrical platen roller 62 for feeding a recording sheet S, which is axially rotatable, a guide rod 64 and a guide rail 66 respectively arranged in parallel to the platen roller 62, and a carriage 9 mounted on the guide rod 64 and a guide rail 66 so as to be movable in parallel to the platen roller 62. An ink jet head 10 is mounted on the carriage 9. This ink jet head 10 has a plurality of nozzles on a side facing the platen roller 62, from each of which ink is ejected onto the recording sheet S put on the platen roller 62 to perform printing. Those nozzles are divided into groups according to colors, as will be mentioned later. The carriage 9 is driven through a belt 70 by a CR motor 68 disposed under the casing 60.

As a recovery mechanism for removing ink ejection errors of the ink jet head 10, provided are a wiper 15, a purge pump 44 and a purge cap 46 in the casing 60. Protective caps 48 for protecting the nozzle faces of the ink jet head 10 in a home position, are provided in a line with the purge cap 46, where the number of the protective caps 48 corresponds to that of groups of the nozzles.

The wiper 15 will further be explained hereinafter with reference to FIG. 2. The wiper 15 is constructed of a main part 16 and a lower contacting part 17 which are integrally formed. The wiper 15 is held in a wiper holder 30 having an engaging pin 31 at a back end thereof. A cam 32 with a circular cam groove 33 is arranged behind the wiper holder 30. The engaging pin 31 is engaged in the cam groove 33.

Figure 2:
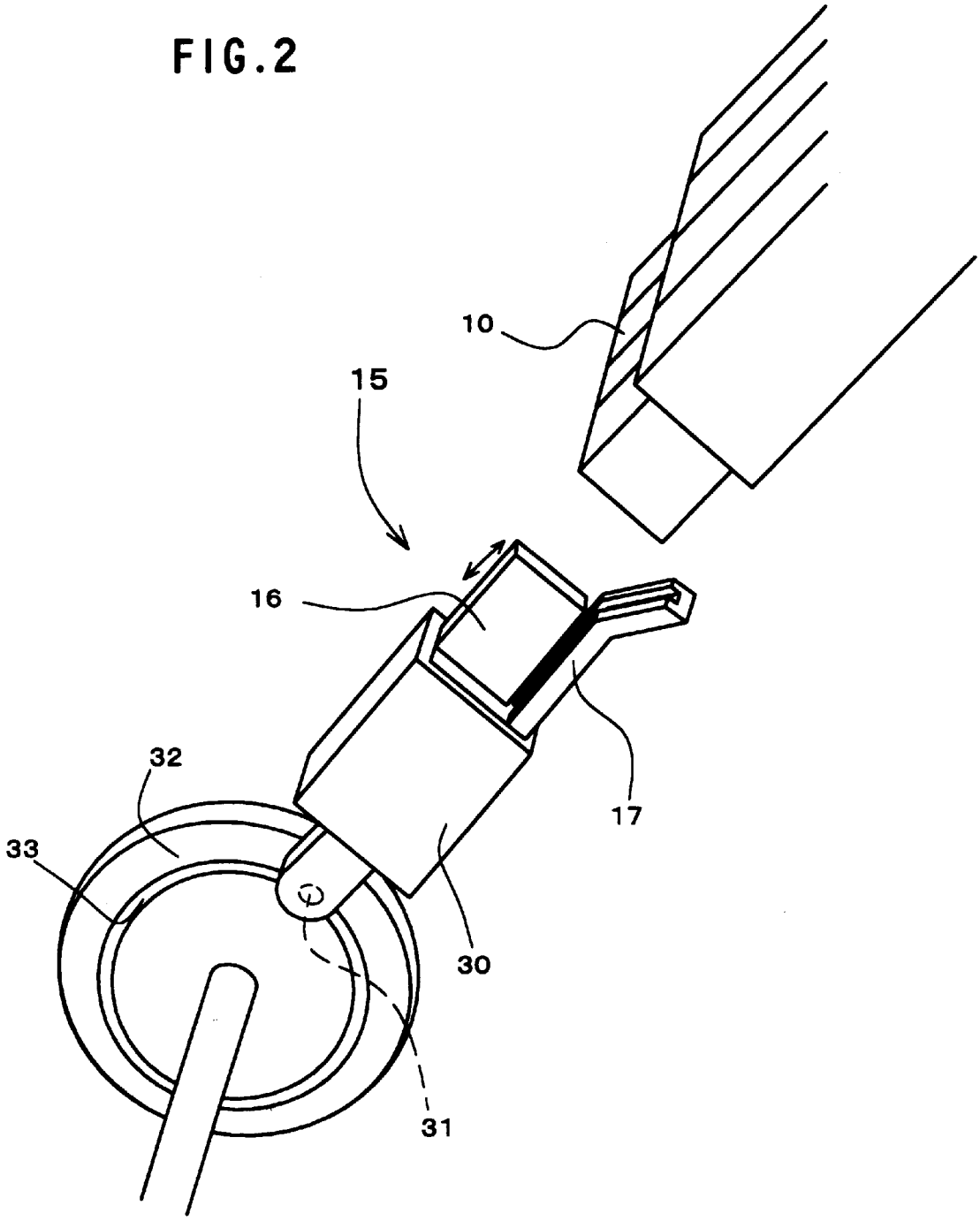
FIG. 2 is a perspective view of an ink jet head and a wiper member.
Figure 8:
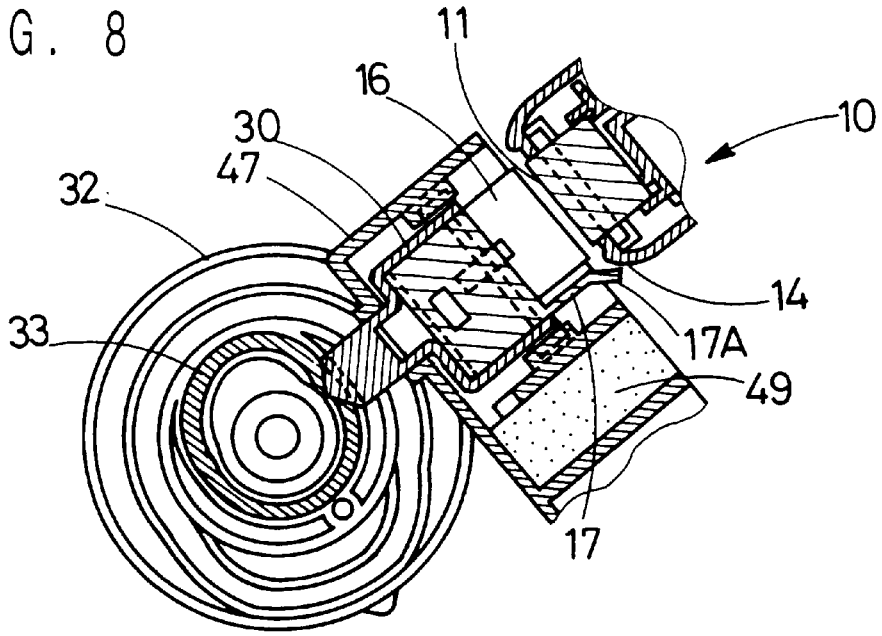
FIG. 8 is a sectional view for explaining a state where the wiper is moved back.
Figure 9:
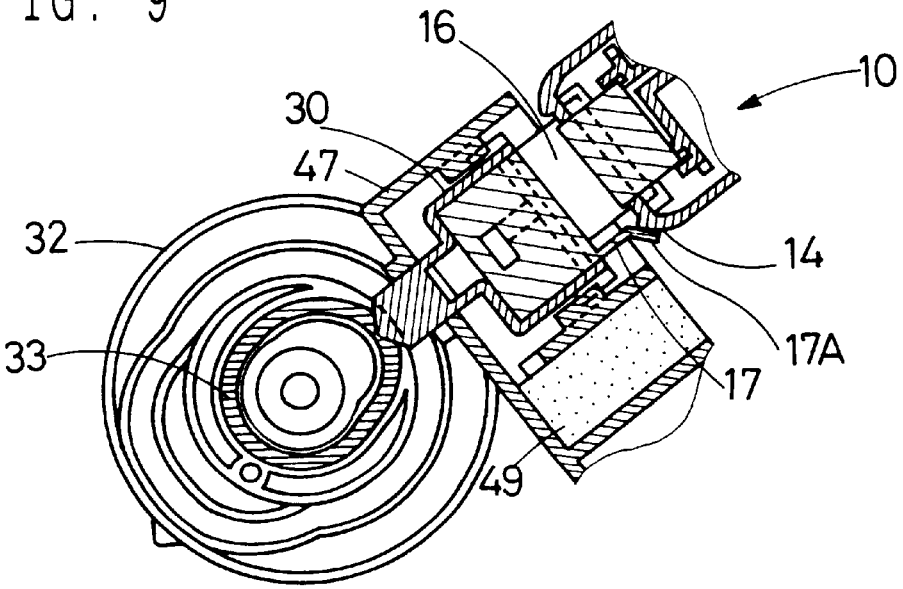
FIG. 9 is a sectional view for explaining a state where the wiper is moved forward.

This wiper holder 30 is fixedly fitted to a cap case 47 for holding the purge cap 46, not illustrated in FIG. 2, so as to be slidable forward and backward with respect to the ink jet head 10. Accordingly, with the rotation of the cam 32, the wiper 15 together with the wiper holder 30 can move forward and backward. The wiper 15 moved backward is not in contact with the ink jet head 10. On the other hand, the wiper 15 moved forward comes into contact with the nozzle faces by the main part 16 and with the lower front portion 14 by the lower contacting part 17 respectively when the ink jet head 10 is moved toward a printing area. Those states are shown in FIG. 8 and FIG. 9, where FIG. 8 is a state of the wiper 15 being moved backward and FIG. 9 is a state of the wiper 15 being moved forward. As shown in FIGS. 8 and 9, the cap case 47 is provided with an ink absorbing member 49 formed of porous material such as sponge and the like.

As the material of the wiper 15, there is not any special limitation if only it has flexibility and ink-resistance, whereas ethylene-propylene rubber (EPM or EPDM) and the like are appropriate in total consideration of difficulty in remaining deformed, ink repellency, easy manufacturing, cost and the like.

Figure 3:
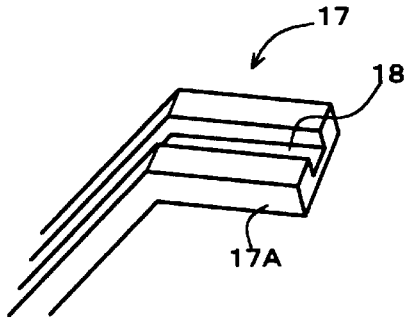
FIG. 3 is a perspective view of a lower contacting part of the wiper.

A more detailed description of the wiper 15 will be provided below. The lower contacting part 17 of the wiper 15 is disposed under the main part 16, having an almost quadrilateral cross-section and a longitudinal groove 18 from the end to the base portion thereof, as shown in FIG. 3. The groove 18 is formed as a channel in which the ink wiped from the ink jet head 10 is made to flow to the ink absorbing member 49 and is absorbed therein. A bent portion 17A is formed at a top end of the lower contacting part 17 so as to come into contact with the lower front portion of the ink jet head 10 at an appropriate angle. The lower contacting part 17, as shown in FIG. 8, is installed at an elevation angle so that the bent portion 17A is positioned higher than the other portion of the lower contacting part 17. In addition, the bent portion 17A is formed so that the portions toward the end are positioned higher when it is not in contact with the ink jet head 10. The lower contacting part 17 is also formed so that the portions, except the bent portion 17A, toward the end are positioned higher.

Figure 4:
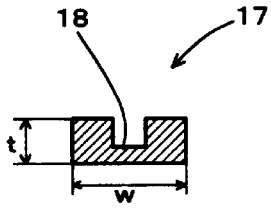
FIG. 4 is a sectional view of the lower contacting part.
Figure 5:
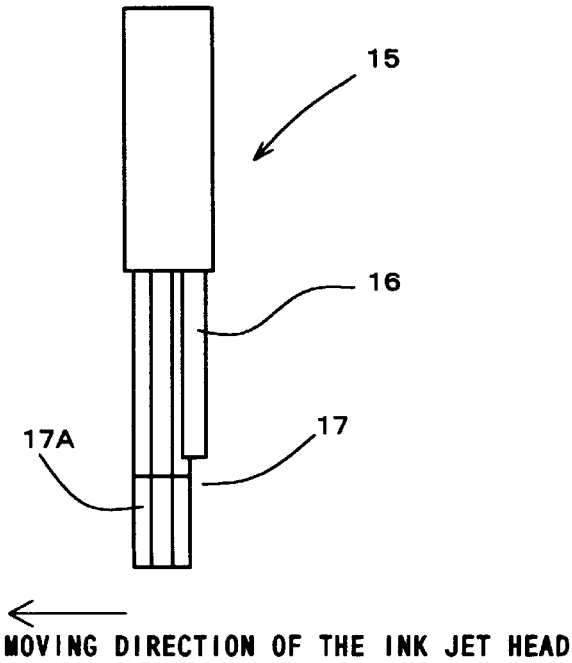
FIG. 5 is a plan view of the wiper member showing the relation in angle between a main part, the lower contacting part of the wiper and a bent portion.
Figure 3A:
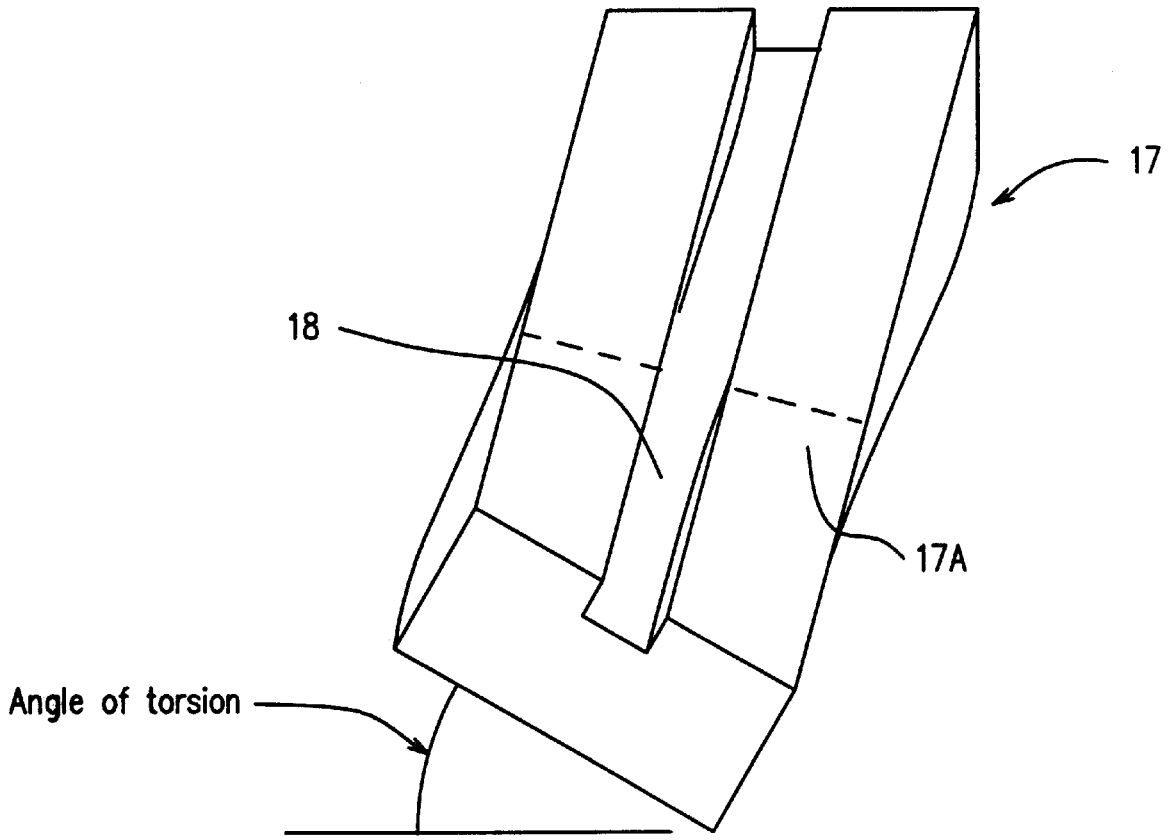
FIG. 3A is a is a perspective view of the lower contacting part of the wiper showing an angle of torsion.

As shown in FIG. 4, the cross-section of the lower contacting part 17 is designed to have a width "w" larger than a thickness (height) "t" so that it can easily be bent in coming into contact with the lower front portion 14 of the ink jet head 10. This is because, when the bent portion 17A comes into contact with lower front portion of the ink jet head 10, the end portion of the lower front portion is first brought into contact with the upper surface of the bent portion 17A thereby to allow the bent portion 17A to naturally and smoothly slide under the ink jet head 10.

Figure 6:
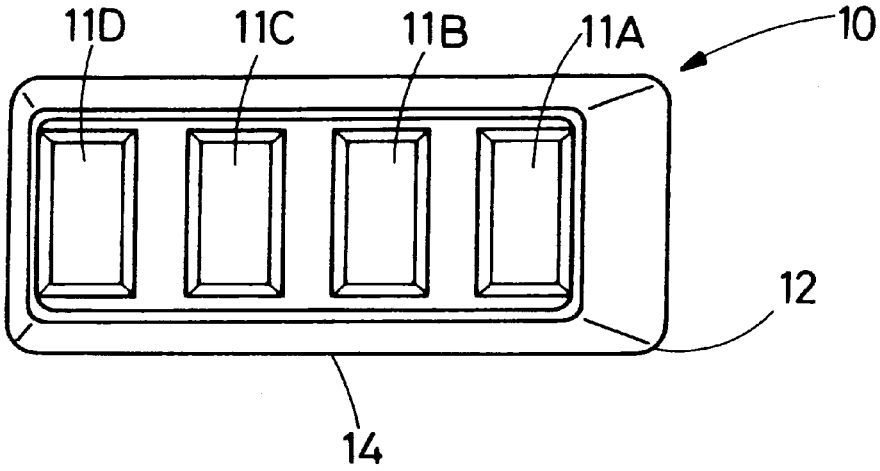
FIG. 6 is a front view of the ink jet head with curved corners.
Figure 7:
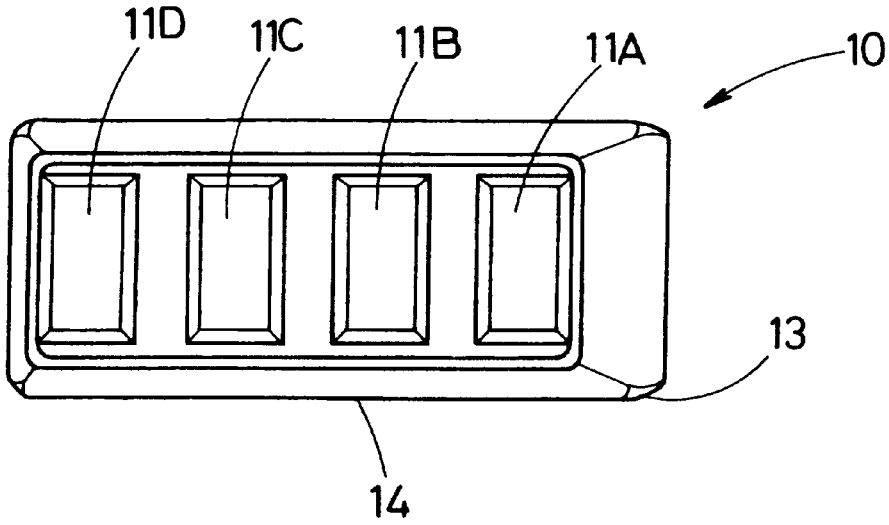
FIG. 7 is a front view of the ink jet head with chamfered corners.

The front surface (nozzle surfaces) of the ink jet head 10 which comes into contact with the wiper 15 will be described hereinafter, with reference to FIG. 6 showing a front view of the ink jet head 10 taken from a platen roller 62 side. There are provided nozzle faces 11A, 11B, 11C and 11D according to colors, each nozzle face being provided with a group of nozzles for ejecting ink with a corresponding color. Those nozzle faces 11A through 11D are formed with the same height and, accordingly, they all will be wiped sequentially by the wiper 15. In the embodiment, one side 12 of the lower front portion 14 of the ink jet head 10 is formed with a curve by rounding off the corners thereof in order to allow the bent portion 17A to naturally slide under the lower front portion 14 of the ink jet head 10 upon coming into contact with the upper surface of the bent portion 17A in a wiping operation. The side 12 of the lower end front portion 14 may be replaced with a side 13 with a slant face formed by chamfering the corner instead of rounding it off as shown in FIG. 7.

Next, operation of the ink jet recording apparatus will be explained. Basic operation of the ink jet recording apparatus is to perform print recording by ejecting ink from the nozzles of the ink jet head 10 onto a recording sheet S arranged on the platen roller 62 in accordance with recording data while moving the carriage 9 through the belt 70 by driving the CR motor 68.

On standby to receive recording data, for example, the carriage 9 is moved to a position where the nozzle faces 11A, 11B, 11C and 11D of the ink jet head 10 are covered by the protective caps 48 respectively thereby to prevent an increase in viscosity of ink. Also, in order to prevent deterioration of ink such as the generation of air bubbles and the solidification of ink and the like in the inside of the ink jet head 10, a purging operation for recovering the ink ejection condition is performed regularly or when necessary by covering the nozzle faces 11A, 11B, 11C and 11D in sequence with the purge cap 46 and then purging by the purge pump 44.

Surplus ink remains on the purged nozzle faces immediately after the purging operation. Accordingly, a wiping operation using the wiper 15 is performed to remove the surplus ink in order to prevent the surplus ink from forming spots on the recording sheet S. The surplus ink stays mainly near the nozzle orifices, i.e., on each nozzle face 11A through 11D, whereas a part thereof is moved to and remains at the lower front portion 14 of the ink jet head 10 because that portion is the lowest position of the ink jet heads as is clear from FIG. 8. Even in addition to the time immediately after the purging operation, a wiping operation is performed if surplus ink is collected in the lower front portion 14 owing to the ink ejection. In performing the wiping operation at the time of except right after the purging operation, the carriage 9 is driven to move to a position where the ink jet head 10 faces the protective caps 48.

The wiping operation is conducted as the following steps.

The cam 32 is rotated at first to move forward the wiper 15 as shown in FIG. 9. The carriage 9 is then driven to move the ink jet head 10 from a position where it faces the protective caps 48 to a position where it faces the platen roller 62. Upon movement of the ink jet head 10, owing to the wiper 15 being in a forward position, the nozzle faces 11A, 11B, 11C and 11D come into contact with the main part 16 of the wiper 15, and the lower front portion 14 of the ink jet head 10 comes into contact with the lower contacting part 17, more specifically the bent portion 17A, respectively. Thus, the wiper 15 being flexible is bent due to the contact with the ink jet head 10, thereby to wipe the surplus ink.

In performing the wiping, when the lower front portion 14 of the ink jet head 10 comes into contact with the bent portion 17A of the wiper 15, the one side 12 (or 13) of the lower front portion 14 first comes into contact with the upper surface of the bent portion 17A. With movement of the ink jet head 10, the side end 12 (or 13) of the lower front portion 14 pushes the bent portion 17A downward and the whole lower contacting part 17 is bent downward. The bent portion 17A is thus naturally slid under the lower front portion 14, wiping up ink therefrom. Since the side end 12 (or 13) is formed with a curved shape (or a chamfered shape) as shown in FIG. 6 (or FIG. 7), this is also helpful to the smooth sliding motion of the bent portion 17A under the lower front portion 14. Furthermore, the lower contacting part 17 comprising the bent portion 17A is formed with a cross-section having a width "w" larger than a thickness "t" as shown in FIG. 4. It is also helpful to the smooth bending of the bent portion 17A.

At the same time, the main part 16 of the wiper 15 comes into contact with the nozzle faces 11A through 11D of the ink jet head 10 in sequence, as shown in FIG. 9. In this way, the nozzle faces 11A through 11D and the lower front portion 14 which are portions where surplus ink is apt to gather, are wiped respectively to remove the surplus ink therefrom.

This wiping operation causes the surplus ink attached on the lower front portion 14 of the ink jet head 10 to move into the bent portion 17A. Since the lower contacting part 17 having the bent portion 17*a* is provided with the groove 18 as shown in FIG. 3, the ink moved into the bent portion 17A is made to flow in the groove 18 and is absorbed by the ink absorbing member 49 provided in the cap case 47. In particular, upon completion of the contact between the lower front portion 14 and the bent portion 17A according to the movement of the ink jet head 10, the bent portion 17A is released from a bending state and returns to its natural state. At this time, the portions toward the end of the bent portion 17A are positioned higher and also the bent portion 17A is positioned higher than the other portion of the lower contacting part 17 due to the elevation angle, so that the ink is made to all flow in the groove 18 toward the ink absorbable member 49 being left in the bent portion 17A. The bent portion 17A is thus cleaned and the next wiping operation will be performed with it.

Upon completion of the wiping operation, the carriage 9 is moved to the position where the ink jet head 10 faces the platen roller 62, whereby print recording can be started. At this state, the surplus ink has been removed from the nozzle faces 11A through 11D and the lower front portion 14. This makes it possible to perform printing with high quality without forming ink spots on the recording sheet S by the surplus ink. Upon completion of the wiping operation, the cam 32 is rotated to move the wiper 15 back, referring to FIG. 8, in order to prevent the ink jet head 10 from coming into contact with the wiper 15 each time when the carriage 9 is moved to a position, for example, where the ink jet head 10 faces the protective caps 48.

As in detail described above, according to the ink jet recording apparatus in the embodiment, the wiper 15 for wiping the ink jet head 10 is provided with the main part 16 for wiping the nozzle faces 11A though 11D and the lower contacting part 17 for wiping the lower front portion 14 of the ink jet head 10, so that the wiper 15 can wipe not only the nozzle faces 11A through 11D where surplus ink will generate, but also the lower front portion 14 which the surplus ink is moved to and collected in. As a result, print recording is performed with the clear ink jet head 10 from which the surplus ink is fully removed, preventing spots formed by the surplus ink on the recording sheet S.

Since the groove 18 is continuously formed extending for the full length of the lower contacting part 17 including the bent portion 17A, the surplus ink moved from the lower front portion 14 of the ink jet head 10 to the lower contacting part 17 in the wiping operation, flows in the groove 18 to the cap case 47 and is absorbed in the ink absorbing member 49.

When the ink jet head 10 is separated from the lower contacting part 17 after completion of the wiping operation, the lower contacting part 17 returns to a natural state with an elevation angle whereby the portions toward the end are positioned higher, so that the surplus ink is moved to the cap case 47 under the influence of gravity without remaining in the lower contacting part 17. By the use of the cleaned lower contacting part 17, the next wiping operation can be performed with the sure effect of wiping.

As mentioned above, the lower contacting part 17, having a width larger than a thickness in cross-section, can easily be bent in the wiping operation. At the start of wiping, thus, the side end 12 (or 13) in a curved (or chamfered) form, of the lower front portion 14 comes into contact with the upper surface of the bent portion 17A, so that the bent portion 17A can slide smoothly under the lower front portion 14, thereby enabling a smooth wiping operation.

The present invention may be embodied in other specific forms without departing from the spirit or essential characteristics thereof. For instance, the specific shape of each component, and the material of the wiper, and the like, mentioned in the embodiment are merely examples.

The foregoing description of the preferred embodiment of the invention has been presented for purposes of illustration and description. It is not intended to be exhaustive or to limit the invention to the precise form disclosed, and modifications and variations are possible in light of the above teachings or may be acquired from practice of the invention. The embodiment chosen and described in order to explain the principles of the invention and its practical application to enable one skilled in the art to utilize the invention in various embodiments and with various modifications as are suited to the particular use contemplated. It is intended that the scope of the invention be defined by the claims appended hereto, and their equivalents.

Figure 10:
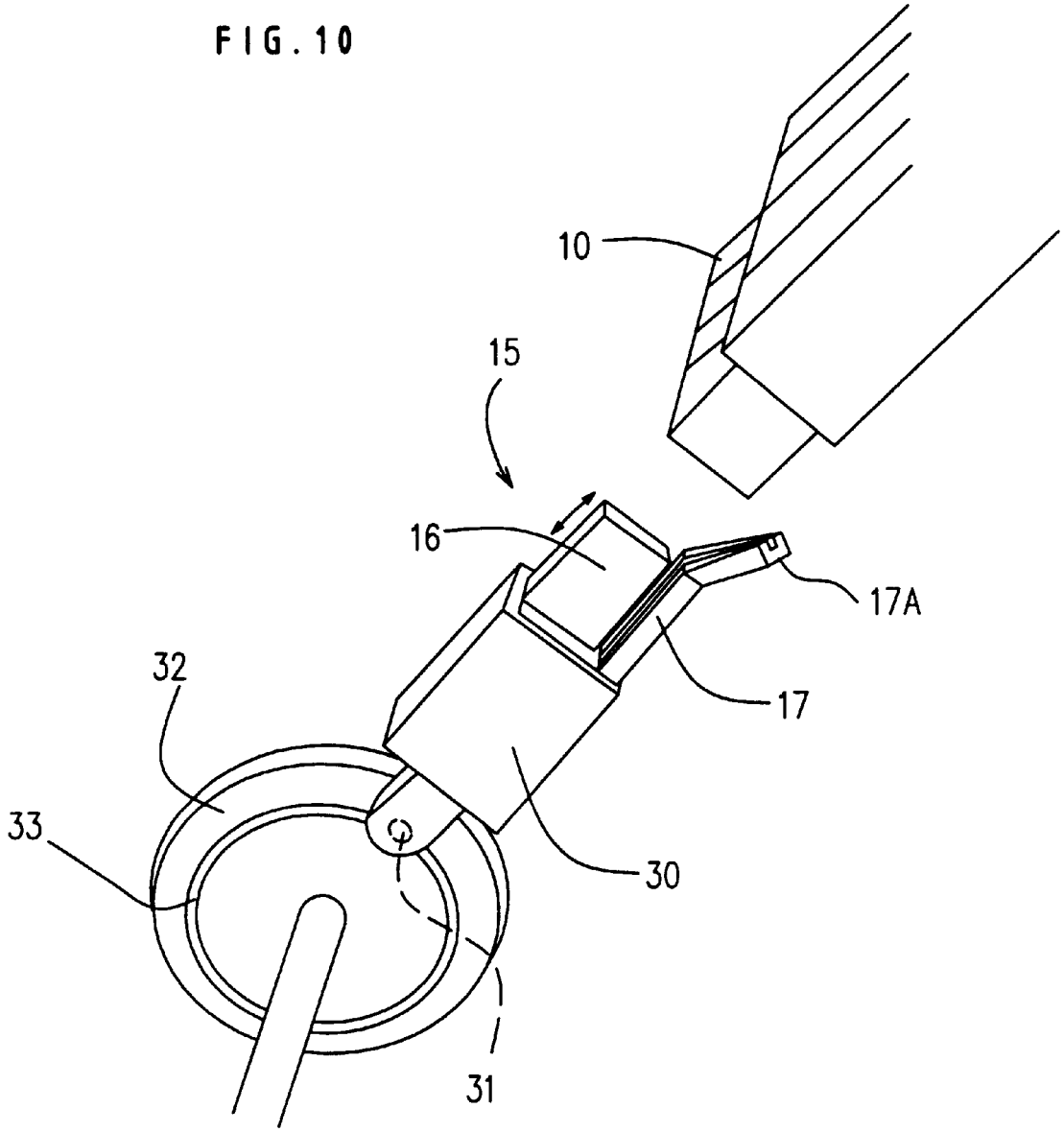
FIG. 10 is a perspective view of the ink jet head and the wiper member according to a first modification of the present invention.

For instance, the embodiment mentioned above can be modified as shown in FIG. 10. FIG. 10 perspectively shows a main part of the first modification according to the present invention. Here, since the structure of the ink jet head 10 and the wiper 15 is basically the same as that of the embodiment mentioned above, only the characteristic structure of the first modification will be explained in the following.

In FIG. 10, the lower contacting part 17 of the wiper 15 is partially formed at an angle of torsion so that the upper surface of the bent portion 17A is inclined. Concretely, as shown in FIG. 10, the upper surface of the bent portion 17A is inclined so that the left side of the upper surface is positioned higher than the right side of the upper surface. Therefore, the entire upper surface of the bent portion 17A is obliquely directed toward the lower surface of the ink jet head 10 which moves toward the recording area from a home position in a wiping operation.

In performing the wiping operation, when the lower front portion 14 of the ink jet head 10 comes into contact with the bent portion 17A of the wiper 15, the one side 12 (or 13) of the lower front portion 14 first comes into contact with the upper surface of the bent portion 17A since the upper surface of the bent portion 17A is inclined so as to direct toward the lower surface of the ink jet head 10.

As mentioned above, since the upper surface of the bent portion 17A is inclined, the bent portion 17A can contact with the lower surface of the ink jet head 10 when the wiping operation is conducted and can certainly wipe the ink remaining in the lower surface of the ink jet head 10.

Figure 11:
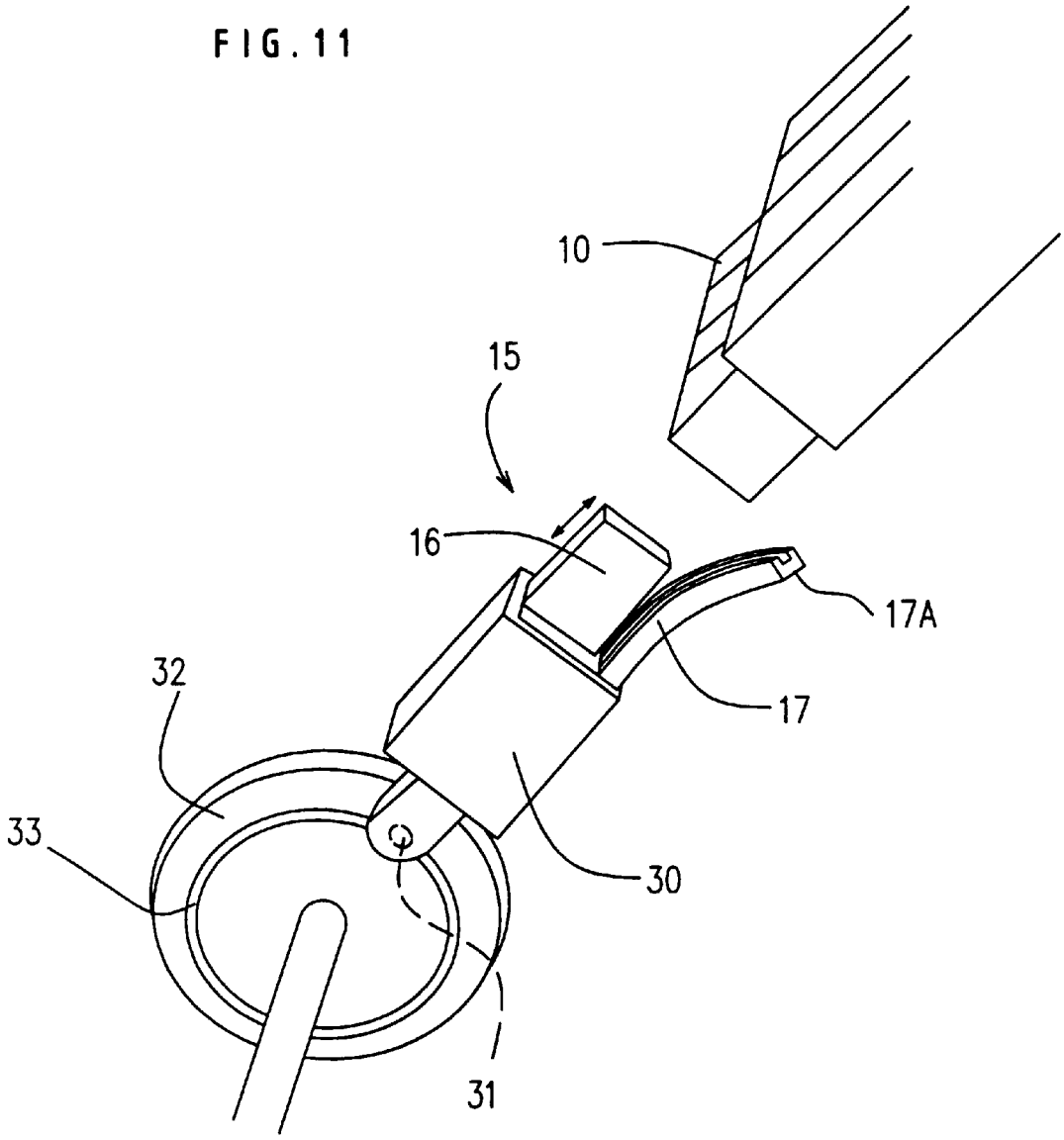
FIG. 11 is a perspective view of the ink jet head and the wiper member according to a second modification of the present invention.

Further, the embodiment can be modified as shown in FIG. 11. FIG. 11 perspectively shows a main part of the second modification according to the present invention. In the second modification, the lower contacting part 17 is entirely twisted so that the entire upper surface of the lower contacting part 17 is obliquely directed toward the lower surface of the ink jet head 10. In performing the wiping operation, when the lower front portion 14 of the ink jet head 10 comes into contact with the bent portion 17A of the wiper 15, the one side 12 (or 13) of the lower front portion 14 first comes into contact with any of the upper surfaces of the lower contacting part 17 and the bent portion 17A since the upper surface of the lower contacting part 17 is inclined so as to direct toward the lower surface of the ink jet head 10. As mentioned above, since the upper surface of the lower contacting part 17 is entirely inclined, the lower contacting part 17 including the bent portion 17A can contact with the lower surface of the ink jet head 10 when the wiping operation is conducted and can certainly wipe the ink remaining the lower surface of the ink jet head 10.

What is claimed is:

1. An inkjet recording apparatus comprising an ink jet head for ejecting ink from nozzles on a recording media, the ink jet head being disposed in an inclined state, a wiper member for wiping the ink jet head, the wiper member being disposed in-line with the ink jet head at a position lower than the ink jet head, and a drive mechanism for moving the wiper member to a first position where the wiper member contacts with the ink jet head and a second position where the wiper member separates from the ink jet head, wherein the wiper member further comprises:

a main part for wiping faces of the nozzles of said ink jet head;

a lower contacting part formed below the main part and having a bent portion formed at a top end of the lower contacting part, the bent portion directly contacting with a lower surface of a front portion in the ink jet head as the wiper member moves to the first position.

2. An ink jet recording apparatus according to claim 1, wherein the wiper member is installed in a wiper holder which is an element of the drive mechanism and a groove in which ink flows toward the wiper holder is formed continuously in an upper surface of said lower contacting part to include the bent portion of the wiper member.

3. An ink jet recording apparatus according to claim 3, wherein an ink absorbing member is positioned below the wiper holder and the ink wiped by the wiper member is directed toward the ink absorbing member by the groove.

4. An ink jet recording apparatus according to claim 2, wherein said lower contacting part of the wiper member is angled upwardly so that the bent portion higher than a remaining portion of the lower contacting part.

5. An ink jet recording apparatus according to claim 2, wherein the groove of the lower contacting part, including the bent portion, is down stream of the main part of the wiper along a moving direction of the ink jet head.

6. An ink jet recording apparatus according to claim 1, wherein said lower contacting part of the wiper member has a cross-section with a larger size in width along a moving direction of the ink jet head than a size in height along a direction normal to the moving direction.

7. An ink jet recording apparatus according to claim 6, wherein said lower contacting part of the wiper member is constructed with an angle of torsion in the moving direction of the ink jet head so that an upper surface of the bent portion smoothly comes into contact with the lower surface of the front portion of the ink jet head at a start of wiping.

8. An ink jet recording apparatus according to claim 7, wherein the lower surface a shape of the front portion of said ink jet head guides the bent portion of the wiper member under the ink jet head at the start of wiping.

9. An ink jet recording apparatus according to claim 8, wherein the lower surface of the front portion of the ink jet head is a curved or chamfered surface.

10. An ink jet recording apparatus according to claim 1, wherein the main part, the lower contacting part and the bent portion are one continuous rubber material body.

11. An ink jet recording apparatus according to claim 10, wherein the rubber material is ethylene-propylene rubber.

* * * * *